United States Patent [19]

Abreu

[11] 4,051,481

[45] Sept. 27, 1977

[54] HELICAL BAND ANTENNA

[76] Inventor: João do Espirito Santo Abreu, Av. Anita Garibaldi, 5147-Curitiba, Parana, Brazil

[21] Appl. No.: 654,938

[22] Filed: Feb. 3, 1976

[30] Foreign Application Priority Data

Jan. 29, 1975 Brazil ..... 7500557

[51] Int. Cl.[2] ..... H01Q 1/36

[52] U.S. Cl. ..... 343/895

[58] Field of Search ..... 343/895, 908

[56] References Cited

U.S. PATENT DOCUMENTS

| | | | |
|---|---|---|---|
| 3,509,578 | 4/1970 | Cribb | 343/895 |
| 3,629,937 | 12/1971 | Fredriksson | 343/895 |
| 3,683,393 | 8/1972 | Self | 343/895 |
| 3,836,979 | 9/1974 | Kurland et al. | 343/881 |

FOREIGN PATENT DOCUMENTS

| | | | |
|---|---|---|---|
| 810,325 | 12/1936 | France | 343/895 |
| 430,548 | 6/1935 | United Kingdom | 343/895 |

*Primary Examiner*—Eli Lieberman

*Attorney, Agent, or Firm*—Emory L. Groff, Jr.

[57] ABSTRACT

An antenna is formed of a flattened tube or plate rectangular in cross section and arranged on a tubular support member in the form of a helix in which the outside diameter of the helix decreases gradually from the base end to the outer end. The wide faces of the helical tube or plate are arranged to face in the direction of the axis of the tubular support member.

2 Claims, 5 Drawing Figures

HELICAL BAND ANTENNA

The present invention refers to innovations introduced in helical type antennas, aiming not only to increase the gain for the bandwidths necessary to radio systems at the UHF band, but also the attainment of better quality in the signal-to-noise ratio, reduction of production costs and more steady impedance than the present ones. In fact, the antennas currently developed and in use are of constant diameter and step and the helical element is made with an iron bar or tube. The utilization of these elements in this geometry creates limitations with respect to gain, bandwidth and antenna impedance. The gain for resonable bandwidth, i.e., in the order of 20% of the central frequency varies from 11 to 13 decibels inside the bandwidth, over the isotropic antenna. To obtain higher gains necessary to ratio systems in the UHF band (mainly from 225 to 1.000 MHz) we use coupled antennas which besides the connection and impedance adaptation problems, leads to the geometric increase of the number of antennas and cost. It also substantially raises the cost of the towers that support them and many times hinders the expansion of the system, by limitation from the existing towers. For instance, to obtain approximately 2.5dB of additional gain we need two coupled antennas, and to obtain 5dB of additional gain over the one-element antenna we need 4 antennas, for 7.5dB of additional gain we need 8 antennas. This coupling of antennas does not permit us to obtain in practice, i.e., in the operating links, the specified gains attained in test field measurements, for due to the diffraction and reflecion conditions, quite common in the absolute majority of UHF links, the curves of the variation of the signal with height, as well as the differences of phase in the wave front, limit the achievement of the predicted additional gains. The impedances of the antennas developed in the current state-of-art are variable inside the bandwidth and above 100 Ohms, requiring the use of transformers that make the impedance transformation to 50 Ohms, which is the standard impedance for coaxial cables, radio equipments and measurements. These impedance transformers increase the production cost, cause additional losses and decrease the antenna reliability because additional contacts are needed in its realization and being coaxial, they are subject to water penetration which, as a general rule, penetrates in the coaxial cable through the transformer.

Figure 1:
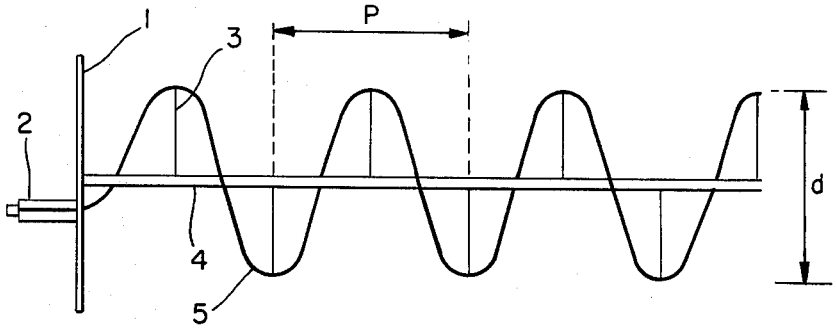
FIG. 1. PRIOR ART
FIG. 1 shows a partly schematic illustration of an antenna known in the prior art.
Figure 2:
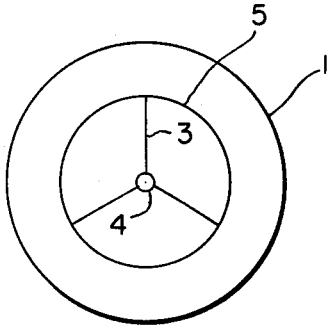
FIG. 2. PRIOR ART
FIG. 2 shows an end view of the antenna of FIG. 1.

The development of the prior art antennas relating to the present invention is illustrated in FIGS. 1 and 2, wherein a ground plane 1 has mounted thereon a supporting member in the form of a supporting tube 4. The tube 4 carries the stand off insulators 3, which carry an antenna made from an iron bar or circular section tube extending helically around supporting tube 4 and out through the ground plane 1. Impedance transformers 2 must be provided in this prior art practice in order to obtain optimum performance. The impedance transformers 2 are shown mounted adjacent the ground plane 1. The step or pitch P is uniform along the helix, and the outside diameter a of the helix is constant along the length of the helix.

Figure 3:
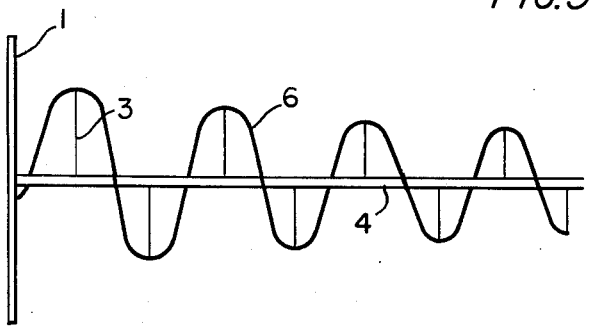
FIG. 3 shows a partly schematic illustration of the antenna of the present invention.
Figure 4:
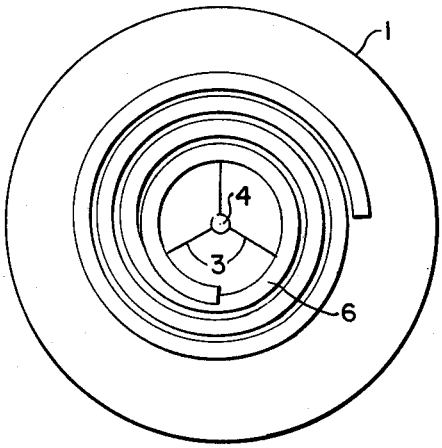
FIG. 4 shows an end view of the antenna of FIG. 3, with the antenna itself shown in its actual shape.
Figure 5:
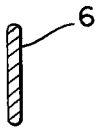
FIG. 5 shows a cross sectional view taken through the material of the antenna.

By way of contrast with the prior art, reference is made to FIGS. 3-5, which illustrate the improvement of applicant's invention. The ground plane 1, support member 4 and stand off insulators 3 support a helical antenna 6, as in FIG. 1. The outside diameter of the helix, however, is progressively smaller from the end adjacent the ground plane to the outer end. Also, the helix is formed from a flattened tube or a bar of rectangular cross section shown in FIG. 5. This cross section has a width of the order of approximately ten times the thickness. It is an important feature of this structure that the wide faces of the helical antenna tube or bar be arranged to face in the direction of the axis of the support member 4. In this improvement, the greater proximity of the material of the helical antenna to the ground plane and the face to face arrangement of the coils of the helix result in optimum performance without the necessity of providing impedance transformers, and also result in the achievement of higher gain, larger bandwidth and less variable impedance on the order of fifty ohms when compared with other helical antennas built according to known techniques.

From these innovations, apparently simple, result sensible differences between the two types described, to be known, exemplifying for confrontation with antennas for 20% of bandwidth:

a. maximum of eight spirals in the usual antennas against a practically unlimited number of spirals in the new antennas;
b. maximum gain of 13 decibels over the isotropic against 18 decibels with 24 spirals in the new ones;
c. variable impedance (without the impedance transformer) and greater than 100 Ohms in the usual ones, against a less variable impedance and approximately equal to 50 Ohms in the new ones;
d. to obtain maximum gain of 15.5 decibels it is necessary two antennas with wind area of 2 $m^2$, and for 18 decibels, four antennas with wind area of 4 $m^2$ while just one of the new antennas with wind area of 1 $m^2$ provides a gain of 18 decibels.

The new antennas can be applied in any radio system in the UHF band, mainly in the frequency range between 200 and 1000 MHz. They work with any kind of equipment, for any channel capacity and bandwidth in which the propagation and current technical conditions allow use to build. They can be coupled forming networks but due to its high gain this proceeding is only needed when the required gain is above 18dB over the isotropic antenna. In view that the antennas resulting from the idealized improvements pursue higher gain, more constant and closer to 50 Ohms impedance, and for having the transformer incorporated with the antenna, the following advantages are resultant: use of lighter and less costly towers while for the present ones of the coupling in networks is necessary. Substitution of up to 4 existing antennas for only one antenna, clearing up space at the existing towers allowing the expansion of the system. Utilization of equipments with lower output power, meaning so, smaller system value.

Attainment of better quality (i.e. signal-to-noise ratio) caused not only by the decrease in thermal noise from the increase in the RF carrier but also for the decrease in the diaphony noise due to the echo originated by the cable-antenna mismatching, which,even with the transformer separated from the antenna is greater in the present ones. Greater system reliability once it pursues a lower number of contacts and is practically immune to water penetration.

Use of a larger number of links in one same state or region due to its higher directivity and allowing an easier elaboration of the plan of frequencies. Lower interference from ignition noises due to the type of polarization, to the directivity and to the axial ratio.

They permit the implantation of links which are impractible with the current antennas, diminishing the need of repeating stations or interconnections with quad and coaxial cables.

Production cost lower than the current ones by the incorporation of the impedance transformer with the antenna.

I claim:

1. In an antenna structure, a ground plane member, an elongated support member extending at a right angle from said ground plane member, stand off insulators extending from said support member, an antenna element mounted on said insulators in the form of a helix of gradually decreasing diameter from said ground plane member, said element having a rectangular cross section having two wide surfaces and two narrow surfaces, and being arranged with its wide surfaces facing in the direction of the axis of the elongated support member.

2. An antenna structure as recited in claim 1, wherein said rectangular cross section has a width of the order of approximately ten times its thickness.

* * * * *